United States Patent [19]

Payen

[11] 4,369,816

[45] Jan. 25, 1983

[54] FANCY, HIGH-STRENGTH FABRIC

[76] Inventor: Pierre Payen, 53, rue Chazière, 69004 Lyon, France

[21] Appl. No.: 307,097

[22] Filed: Sep. 30, 1981

[30] Foreign Application Priority Data

Oct. 2, 1980 [FR] France ..... 80 21384

[51] Int. Cl.[3] ..... D03D 15/00

[52] U.S. Cl. ..... 139/426 R; 428/224; 428/225; 428/229; 428/257; 428/258; 428/259

[58] Field of Search ..... 428/257, 258, 259, 224, 428/225, 229; 139/426 R; 57/207, 208, 227, 228

[56] References Cited

U.S. PATENT DOCUMENTS 4,197,345 4/1980 Worrall ..... 428/365
4,243,713 1/1981 Worrall et al. ..... 156/148

FOREIGN PATENT DOCUMENTS 919501 2/1963 United Kingdom .
1041240 9/1966 United Kingdom .

*Primary Examiner*—James J. Bell
*Attorney, Agent, or Firm*—Stevens, Davis, Miller & Mosher

[57] ABSTRACT

A fancy-type fabric applicable in particular as a coating substrate and of the kind comprising an alternation of warp and filling threads of different colors, the effects being achieved at the interlacing points of two threads of the same color.

The fabric is characterized in that the threads forming the effect consist of wrap threads of a stable circular cross-section and which create floats where they cross on the right fabric side.

6 Claims, 2 Drawing Figures

FANCY, HIGH-STRENGTH FABRIC

Figure 1:
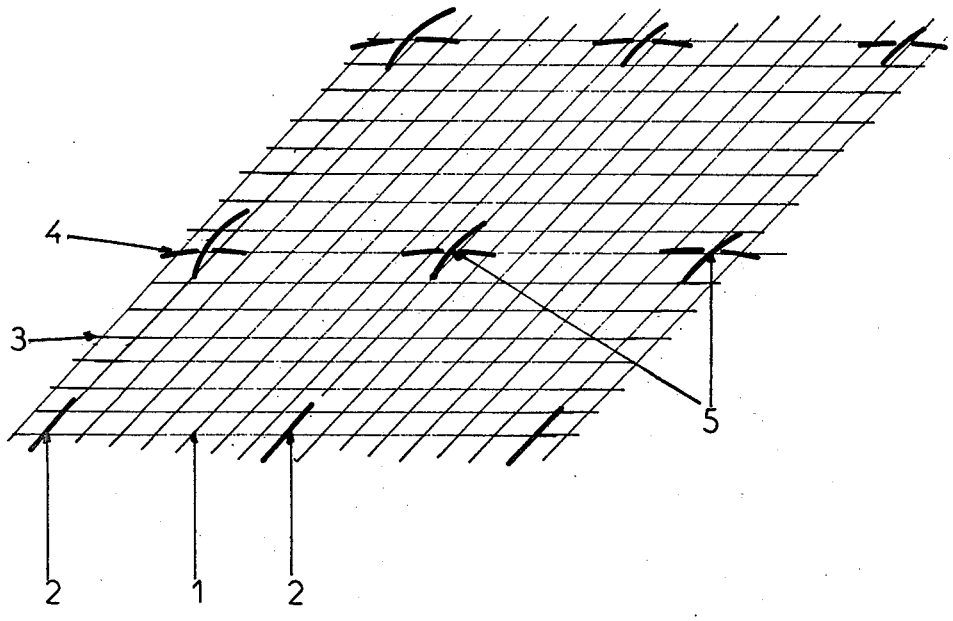

The present invention concerns a novel fabric type with fancy effects localized on its front side and which moreover can be successfully used as a coating substrate to make a variety of articles used for instance as luggage.

The fabrics used to-date as coating substrates as a rule are solid cotton thread fabrics, the weave used being a plain weave or two-thread reps. As a rule the surface effects that may be present in such articles are obtained in finishing, for instance by printing a particular design.

Fancy fabrics also are known which are made using a combination of threads as warps and/or fillings which evince different dyeing affinities whereby, upon a suitable selection of weaves and dyeing, the desired effects can be achieved.

Now the object of this invention is a new type of fabric consisting of warp and filling, which combines threads of different dye affinities and which by the selection of a particular weave permits achieving fabrics with localized effects that subsist after a conventional coating treatment. Also, for an equivalent weight of cotton used in a conventional manner as a coating substrate, such a fabric offers substantially improved strength properties (concerning tension, tearing and bursting).

The invention therefore concerns a fancy type fabric which can be used in particular as a coating substrate and of the type comprising alternating threads of different colors in warps and fillings, the effects being obtained where the two threads of the same color cross, the fabric of the invention being characterized in that the effect-forming threads consist of wrap threads with a stable circular cross-sectional shape and forming floats on the front fabric side in the crossing zone. In other words, the effects are achieved by floating warp threads on several filling threads and by floating filling threads on several warp threads where two threads of the same kind intended to achieve an effect cross one another.

Advantageously the effects achieved on the right fabric side are obtained by interlacing one or two warp threads with one or two filling threads of the same kind and separating the effect forming threads from each other by warp and filling threads of a different kind forming the ground of the fabric. The difference in color or appearance between the threads rendering the effect and those making up the fabric ground can be obtained by using threads previously dyed with different dyestuffs, or, preferably, by using threads with different dye affinities behaving in known manner during dyeing.

It has been noted that thanks to the particular selection of the threads with which effects are to be achieved, namely wrap threads with a circular cross-section, and by choosing a particular weave by means of which floats result in the desired effects in warps and fillings, raised effects were obtained. After the conventional coating treatment it is possible therefore and without any additional operation to achieve visible effects on the front side. Also, it has been further noted that due to the relief formed on the fabric front side, the coating layer adheres much more firmly to said fabric, bringing about unquestionable advantages, in particular when such articles are subjected to abrasion.

Moreover, advantageously threads of high strength such as those commercially known as KEVLAR® are used as the core of the wrap threads. Preferably in such a case a polyester-based thread will be used as the covering thread, the other threads (warp and filling) making up the fabric ground and being made of nylon, preferably textured by false twisting. In this manner the dyeing effect can be obtained directly during dyeing due to the different dye affinities of nylon and polyester.

The invention and the advantages it offers will be better understood in light of the illustrative implementations provided in non-restrictive manner and in relation to the attached drawings.

Figure 2:
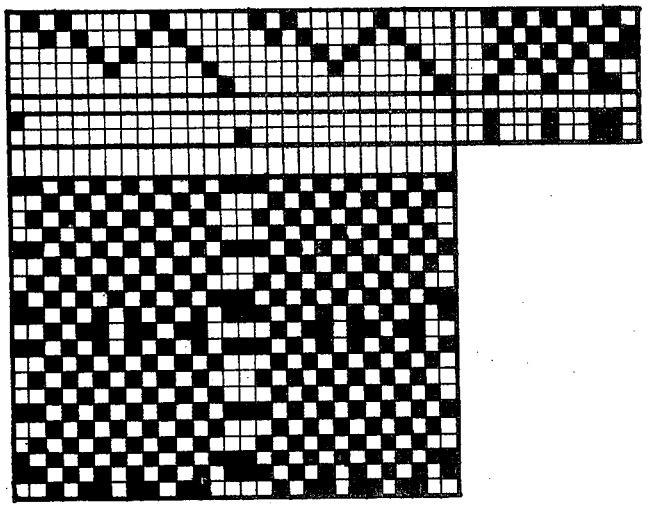

FIG. 1 schematically illustrates a perspective of the fancy fabric achieved in conformity with the invention;

FIG. 2 is a conventional representation of the weave of an illustrative implementation of a fabric of the invention, where this weave permits the expert to precisely reproduce this fabric.

As shown in FIG. 1, the fabric of the invention consists of interlaced warp and filling threads forming a fancy fabric with localized effects on the front side of the fabric.

In conformity with the invention, the warp consists of alternating threads which differ in their nature especially by their colors and are denoted by 1 and 2. The threads 2 for achieving the effects are arranged, whether regularly or not, to be spaced from one another and kept apart from each other by the threads 1 which are intended to form the fabric ground. The filling also consists of a sequence of ground filling threads 3 and effect-forming filling threads 4.

According to the invention, the effects 5 are obtained at the interlacing points of the filling and warp threads 4 and 2, these effects being achieved by floating said warp threads 2 on a plurality of filling threads and said filling threads 4 on a plurality of warp threads. As regards the gaps of the fabric without effects, the threads 2 and 4 are interlaced with the threads 1 and 3 so as to be masked by these latter and so as to appear only on the back side of the fabric.

Preferably the effects 5 are obtained by floats formed by one or two warp threads 2 and one or two filling threads 4.

The floats will be achieved by three or four threads (or, three or four strokes), but it is self-evident such is not a limiting feature.

EXAMPLE

This example is illustrated by the attached FIG. 2 which shows in conventional manner a fabric of the invention.

Such a fabric evinces the following properties:

reed width: 165 cm;

width of finished fabric: 150/155 cm;

warp material: 13 threads 1 each consisting of three assembled nylon threads textured by false twisting and with a 78 decitex titer;

a thread 2 consisting of a wrap thread with an overall titer of 1590 decitex titer of which the core consists of a 1190 decitex KEVLAR® thread and the covering consist of a 167 decitex 38 strand polyester thread;

filling material: 9 strokes of a thread 3 consisting of the same thread as the warp threads 1;

one stroke of thread 4 consisting of the same threads as the warp threads 2;

weight per $m^2$ of fabric: 230 g;

structure of the finished fabric warp: 34/35 threads per cm;

structure of the finished fabric filling: 26 fillings per cm;

reed: 33 threads per cm;

structure of the filling at the loom: 24 fillings per cm;

warp contraction: 6 to 8%; and finished fabric weight: about 250 g/m$^2$.

In the interlacing zones of the threads 2 and 4, such a fabric shows raised effects 5 obtained by the floats of said threads. On the other hand, the fabric assumes a practically solid appearance in the other zones.

Due to the presence of the KEVLAR® threads, such a fabric is of very high mechanical strength.

Following conventional coating, the effects 5 are visible at the fabric sites, and moreover allow better adherence of the coating layer to the surface of this fabric.

Obviously the invention is not restricted to the above described implementation mode, but instead covers also all the variations carried out in the same spirit.

Thus a different alternation between the warp and filling threads than indicated above may be used, for instance the warp may be 10 threads 1 per 2 wrap threads 2 and the filling may be eight strokes of threads 3 per two strokes of wrap threads 4, or on the contrary the patterns may be arrayed in an irregular manner at the right fabric side, for instance by modifying the alternation of the ground threads and of the wrap threads, the essence being that the effects be obtained by interlacing the warp threads and the wrap filling threads floating at the fabric site.

Compared to the prior fabrics used as a coating substrate, such a fabric offers not only the advantage of substantially improved strength, in particular due to the use of wrap threads comprising a high strength core material such as KEVLAR®, but also it permits achieving localized effects on the front side of the fabric which both remain visible after the coating treatment and aid in maintaining the coating layer at the surface of said fabric.

Obviously such a fabric also might be used as such without any coating.

What is claimed is:

1. In a fancy woven fabric, applicable in particular as a coating substrate, of the kind comprising in warp and in weft an alternation of threads of different nature, effects being obtained at the crossing point of at least one warp thread with at least one filling thread, the improvement consisting in that:

(a) wrap type warp and filling threads form the effects, said wrap threads being of the same nature and each comprising a core and a covering thread and having a stable circular cross section, and said effect forming threads are kept apart from one another by warp threads and filling threads of a different nature from the effect forming threads, which threads of a different nature form the fabric ground; and (b) the effects are obtained by floats in warp and filling on the front face of the fabric and are raised.

2. A fabric according to claim 1 wherein threads of high strength are used as the cores of the wrap threads forming the effects, the covering thread being polyester based, while the other warp threads and filling threads forming the fabric ground are nylon threads textured by false twisting.

3. A fabric according to claim 1 or 2 wherein a difference in color or in appearance between the effect forming threads and those of different nature forming the fabric ground is achieved by using threads previously dyed in different dyestuffs.

4. A fabric according to claim 1 wherein a difference in color or appearance between the effect forming threads and those forming the fabric ground is achieved by using threads with different dye affinities evinced in known manner during dyeing.

5. A fabric according to claim 4 wherein threads of high strength are used as the cores of the wrap threads forming the effects, the covering thread being polyester based, while the other warp threads and filling threads forming the fabric ground are nylon threads textured by false twisting.

6. A fabric according to claim 1 wherein said wrap type warp and filling threads forming the effects are of the same color.

* * * * *